US006142061A

United States Patent [19]

Bandieri et al.

[11] Patent Number: 6,142,061

[45] Date of Patent: Nov. 7, 2000

[54] HIGH CAPACITY DIAPHRAGM PUMPING UNIT

[75] Inventors: Ivan Bandieri; Fabrizio Fabbri, both of Modena, Italy

[73] Assignee: Annovi Reverberi S.P.A., Modena, Italy

[21] Appl. No.: 09/295,274

[22] Filed: Apr. 20, 1999

[30] Foreign Application Priority Data

May 4, 1998 [IT] Italy ..... RE98A0050

[51] Int. Cl.[7] ..... F01B 1/00; F04B 1/04

[52] U.S. Cl. ..... 92/72; 417/273

[58] Field of Search ..... 92/72, 73; 417/273, 417/534, 536

[56] References Cited

U.S. PATENT DOCUMENTS

| | | | |
|---|---|---|---|
| 2,146,123 | 2/1939 | Logan . | |
| 4,778,349 | 10/1988 | Browning . | |
| 4,963,075 | 10/1990 | Albertson et al. . | |
| 5,332,372 | 7/1994 | Reynolds | 417/393 |
| 5,573,385 | 11/1996 | Chevallier | 417/393 |
| 5,649,813 | 7/1997 | Able et al. | 417/387 |
| 5,707,217 | 1/1998 | Loeffler | 417/339 |
| 5,730,587 | 3/1998 | Snyder et al. | 417/413.1 |

FOREIGN PATENT DOCUMENTS 1406306 9/1975 United Kingdom .

*Primary Examiner*—Teresa Walberg
*Assistant Examiner*—Vinod D Patel

[57] ABSTRACT

A pumping unit, consisting of two side-by-side identical pumps (1) linked together, each comprising a star arrangement of pistons (9) which at one end are linked to a shaft (7) with a crank (77), and at the other end comprise respective pumping diaphragms (11) housed in corresponding operating chambers (13), each chamber (13) being provided with an intake valve (130) and a delivery valve (131), comprises a common intake or delivery manifold (3) located between the facing sides of said two pumps, and having a single branch for connection to the supply of fluid to be pumped, or to the device using the pumped fluid, and respective branches for connection to said operating chambers for said diaphragms.

13 Claims, 3 Drawing Sheets

HIGH CAPACITY DIAPHRAGM PUMPING UNIT

This invention relates to a diaphragm pumping unit, a typical but not exclusive use of which is in the agricultural sector, in particular for treating crops in general.

For such uses diaphragm pumps are known comprising briefly a series of pistons distributed in the manner of a star about a rotary shaft with a central control crank and having their heads each provided with a pumping diaphragm.

Between said pumping diaphragms and the heads of the cylinders in which said pistons slide there are defined a like number of operating chambers, which are connected by way of suitable automatic intake and delivery valves to corresponding intake and delivery manifolds respectively.

These latter are removably fixed to the pump casing at one end and the other of said rotary shalt with the central crank.

In said typical sector in which such pumps are used, relatively low throughputs are normally required, and only in a few specific cases are the required throughputs very much greater than those provided by a single pump of usual production.

Consequently because of such a limited requirement for pumps of very high throughput and the considerable investment which would be necessary to construct a specific production line, pump manufacturers currently satisfy such requirements by assembling units comprising two complete pumps of the type described in the introduction.

Essentially, said unfits consist of two usual diaphragm pumps having their shafts linked together, they thus comprising two casings containing the pistons, two intake manifolds and two delivery manifolds.

However such units have proved unsatisfactory for the following reasons, due mainly to the presence of said two intake manifolds:

- very large pressure drops due to the complex ducting connecting the operating chambers of the two pumps to the supply of fluid to be pumped,
- consequent risk of cavitation arising, with corresponding noise increase, throughput decrease and shortening of the useful life of the components involved in this phenomenon, and
- excessive complexity, weight and cost deriving from said double connection of the unit pumps to said supply.

The main object of this invention is to obviate the aforesaid within the context of a construction which is simple, rational, reliable and of low cost.

Said object is attained by a pumping unit with the characteristics defined in the claims.

Specifically, the two pumps of the unit are provided with a common intake (or delivery) manifold which is interposed between the two facing sides of said two pumps and has a single passage channel for the fluid, said channel comprising a single branch for connection to the supply of fluid to be pumped, or to the device using the pumped fluid, and respective branches for connection to the operating chambers for said diaphragms.

The provision of said common intake or delivery manifold brilliantly overcomes the problems of the known art stated in the introduction, in that:

- the pressure drops are evidently drastically reduced,
- consequently the danger of cavitation decreases, with simultaneous noise decrease, throughput increase and lengthening of the useful life of the pump components, and

- the complexity, weight and cost of the unit are decreased.

Moreover, according to an advantageous characteristic of the invention, said common intake or delivery manifold is provided with independent means for its fixing to the opposing pumps of the unit.

Again, alignment means are preferably provided to ensure perfect coaxiality of the pump shafts on assembling the unit.

Finally, the invention is preferably provided with positioning means by which the pump crankshafts can be positioned in phase opposition during said assembly.

For a better understanding of the characteristics and constructional merits of the invention, reference is made hereinafter to the figures of the accompanying drawings, which illustrate a preferred embodiment thereof by way of non-limiting example.

Figure 1:
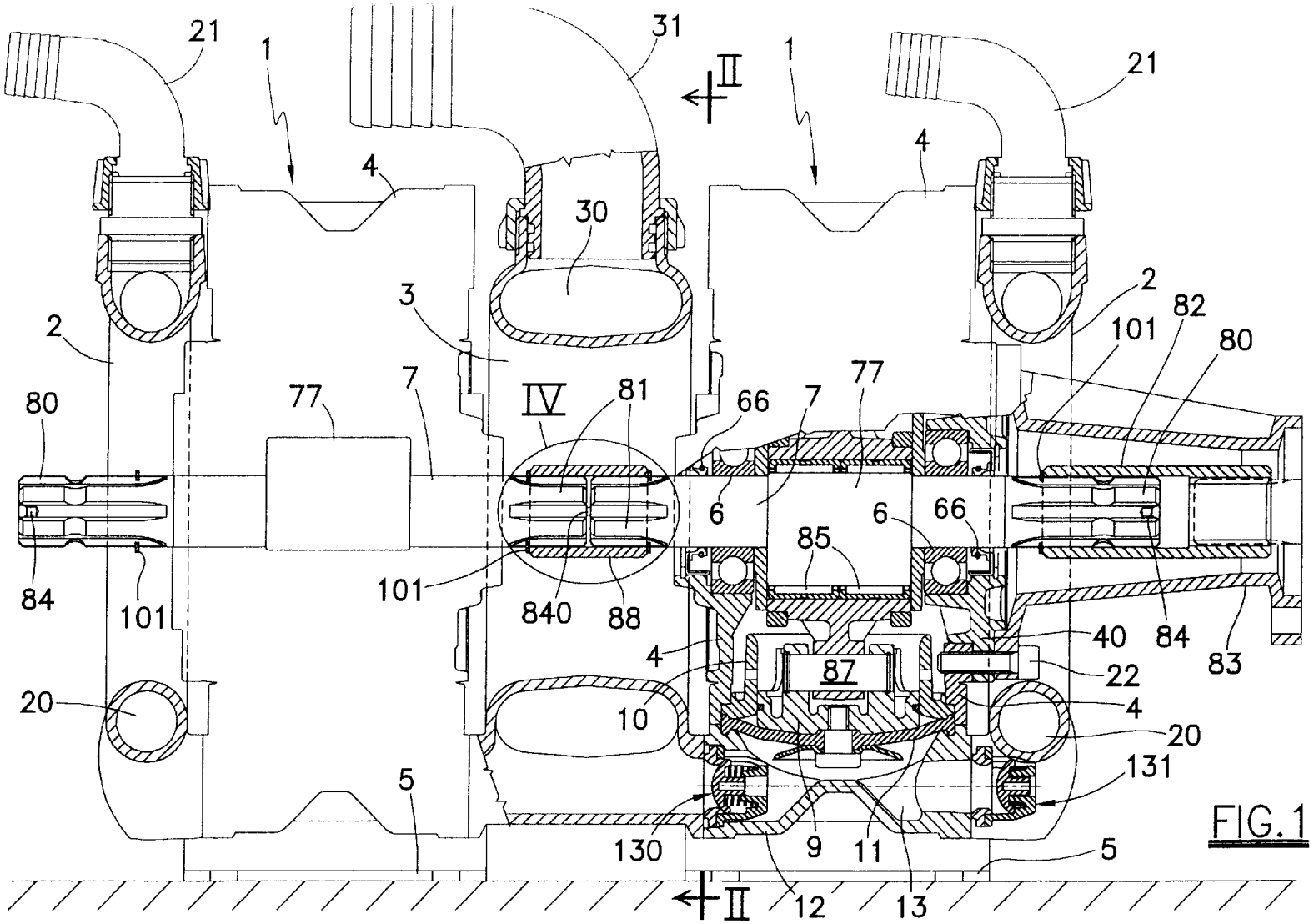
FIG. 1 is an elevational view of the invention, shown partly in longitudinal section.

From said figures, and in particular FIG. 1, it can be seen that the unit comprises two identical diaphragm pumps indicated overall by 1, with which there are associated two identical opposing delivery manifolds 2 of usual type, and a common intake manifold 3 located between said two pumps 1.

It should however be noted that a common delivery manifold and two identical opposing intake manifolds could equally be used.

As can be seen, each pump 1 comprises a casing 4 having a lower connection foot 5 and supporting at its centre, by way of ball bearings 6 and seal rings 66, a horizontal drive shaft 7.

The shaft 7 comprises two opposing splined end portions of different length, the longer portion 80 being associated with the respective delivery manifold 2 and the shorter portion 81 being associated with the common intake manifold 3.

Said longer portion 80 is connected to the splined shaft of a suitable drive motor unit (not shown) via an internally grooved coupling sleeve 82, said shorter portion 81 being connected to the identical portion 81 of the other shaft 7 by means of the internally grooved coupling sleeve 88.

Said motor unit and the pumping unit are connected together by the flange 83, carrying opposing series of fixing screws 22.

As shown in FIG. 1, substantially at the centre of the shaft 7 there is an eccentric portion 77 or crank, which is rotatably housed, by way of roller bearings 85, within a drive ring provided peripherally with a circumferential series of angularly equidistant idle transverse pins 87, which in the illustrated embodiment are four in number.

On each pin 87 there is hinged a respective piston 9 slidable within a cylinder 10, to the head of each piston 9 there being centrally fixed a diaphragm 11, the peripheral edge of which is clamped between said cylinder 10 and a cover 12, this latter being fixed to the casing 4 by threaded members, not visible in the figure.

Between said cover 12 and the respective diaphragm 11 there is defined an operating chamber 13 which on one side is connected to the common manifold via a usual automatic intake valve 130, and on the other side is connected to the delivery manifold 2 via a likewise usual automatic delivery valve 131.

Each of said automatic valves 130, 131, which as stated are of usual type, is arranged to close and open when the other is opened and closed respectively, as shown in FIG. 1.

Figure 2:
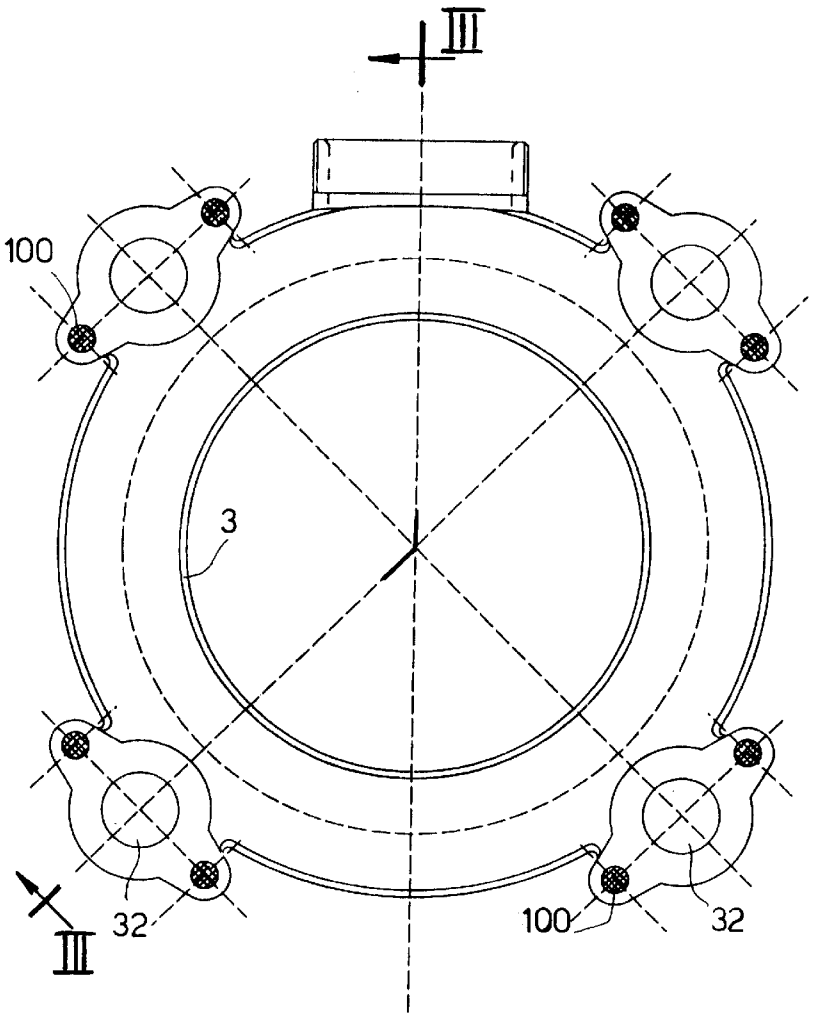
FIG. 2 is a section on the plane II—II of FIG. 1 on an enlarged scale.

The delivery manifolds 2 are fixed to the covers 12 by screws, not shown, positioned at the delivery valves 131, the common intake manifold 3 being fixed to the covers by screws indicated by 100 in FIG. 2.

Specifically, each delivery manifold 2 comprises a peripheral toroidal channel 20 having four entry ports connected to said delivery valves 131 of the respective pump 1, and a connector 21 from which the pumped fluid leaves.

Figure 3:
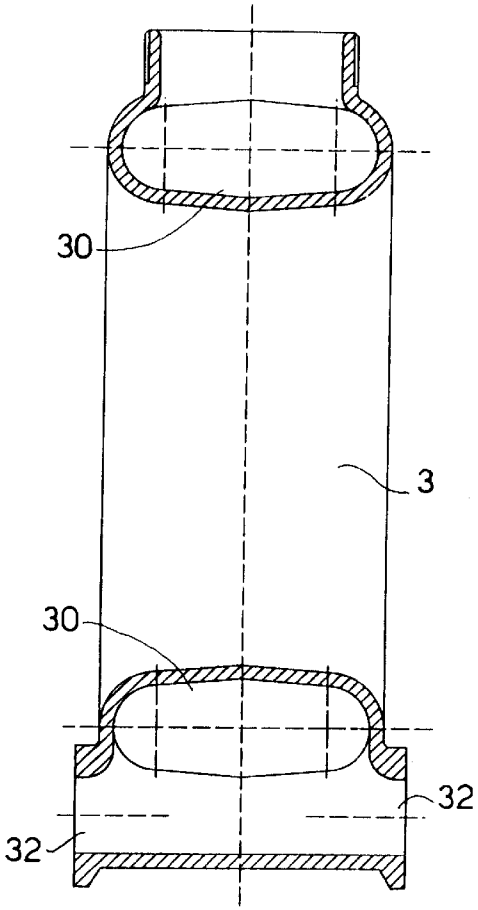
FIG. 3 is a section on the plane III—III of FIG. 2.

According to the invention (see FIGS. 2 and 3), the common intake manifold 3 consists of a flat body of annular shape having a plane of symmetry positioned perpendicular to the longitudinal axis of the unit.

It comprises specifically a toroidal peripheral channel 30 having two opposing groups of four exit ports 32 connected to the eight intake valves 130 of the two pumps 1 of the unit, and a connector 31 (FIG. 1) for entry of the fluid to be pumped.

Figure 4:
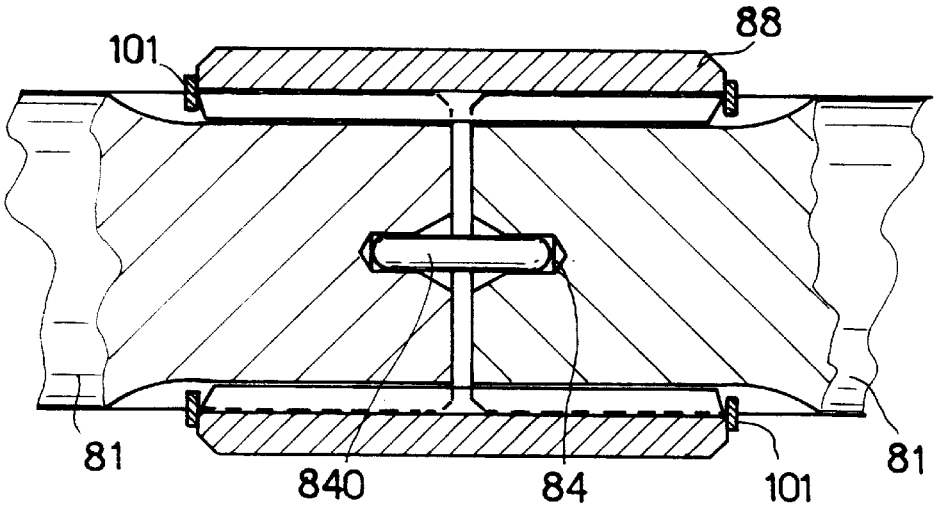
FIG. 4 shows the circled part IV of FIG. 1 on an enlarged scale.

From FIGS. 1 and 4 it can be seen that in each splined portion 80, 81 of the shafts 7 there is provided a dead hole 84 with a flared mouth, to receive as an extremely precise fit a part of an alignment pin 840 for the shafts 7.

Briefly, on assembling the unit the sleeve 88 is mounted on the splined portion 81 of the shaft 7 of one pump 1, the pin 840 is partially inserted into the hole in said splined portion 81, then the other pump 1 is brought into position to mount its hole 84 over said pin 840 and couple its splined portion 81 to said sleeve 88, after which the screws 100 are tightened.

In this manner, perfect coaxiality is achieved between the shafts 7 of the two pumps 1 of the unit.

At the inner end of each splined portion 81 there is provided a circumferential groove for retaining a split ring or the like, which determines correct positioning of said sleeve 88, Instead of said pin 840, other analogous means could be provided such as a ball, a barrel roller, or a rod with frusto-conical opposing ends.

Again according to the invention, means are advantageously provided to minimize any unbalance deriving from the eccentric portions 77 of the shafts 7.

Figure 5:
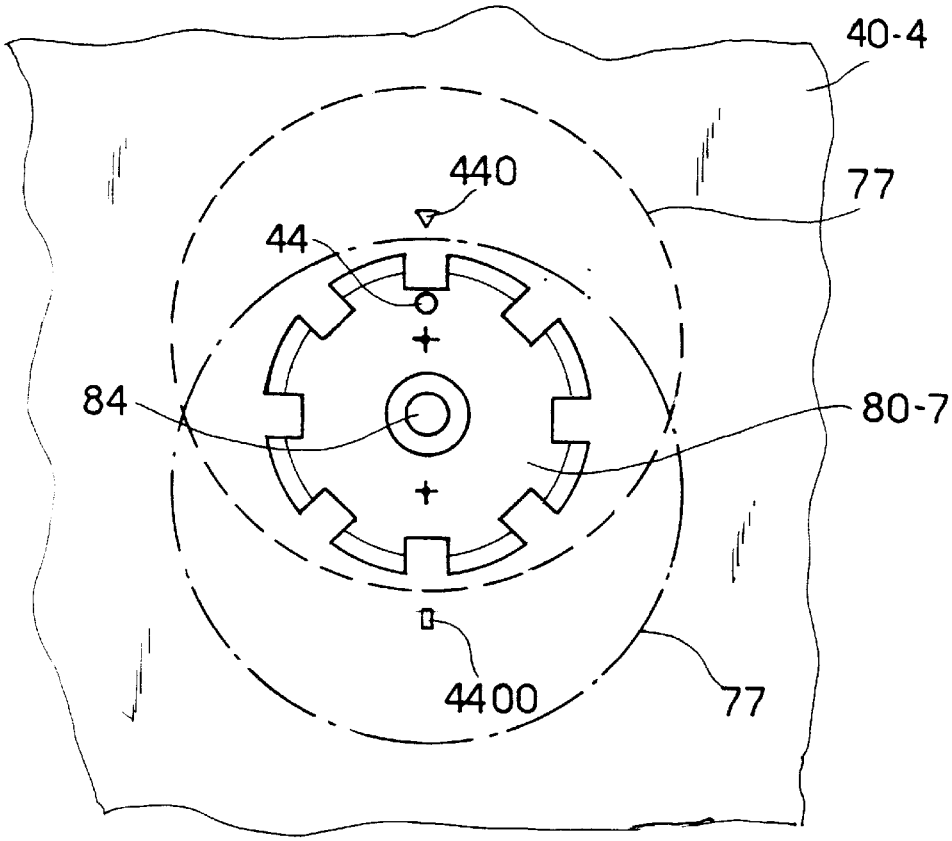
FIG. 5 is a partial view on an enlarged scale in the direction V indicated in FIG. 1.

As shown in FIG. 5, said means comprise:

- a peripheral pointer 44 positioned on the head of the splined portion 80, (preferably) in correspondence with the greater (or lesser) eccentricity of the respective eccentric portion 77, or crank, of the shaft 7,
- a first reference mark 440 located on the corresponding lateral cover 40 of the casing 4, and
- a second reference mark 4400 diametrically opposite the first, and also located on said cover 40.

Said means enable said eccentric portions 77 to be positioned in phase opposition, for example by positioning the pointer 44 facing the reference mark 440 of the right pump 1 of the unit, and the pointer 44 facing the reference mark 4400 of the left pump of the unit.

The merits and advantages of the invention are clear from the aforegoing and from an examination of the accompanying figures.

The invention is not limited to that illustrated and described, but covers all technical equivalents of the stated means and their combinations, if implemented within the context of the following claims.

What is claimed is:

1. A pumping unit, consisting of two side-by-side identical pumps (1) linked together, each comprising a star arrangement of pistons (9) which at one end are linked to a shaft (7) with a crank (77), and at the other end comprise respective pumping diaphragms (11) housed in corresponding operating chambers (13), each chamber (13) being provided with an intake valve (130) and a delivery valve (131), characterised by comprising a common intake or delivery manifold (3) located between the facing sides of said two pumps, and having a single branch for connection to the supply of fluid to be pumped, or to the device using the pumped fluid, and respective branches for connection to said operating chambers for said diaphragms.

2. A unit as claimed in claim 1, characterised in that said common manifold (3) comprises an annular body having a plane of symmetry positioned perpendicular to the longitudinal axis of said shafts (7), and is provided with a toroidal peripheral channel (30) having a single fluid arrival or departure port and two opposing series of ports (32) arranged to mate with the seats of said intake or delivery valves.

3. A unit as claimed in claim 1, characterised in that said common manifold is provided with means for its independent fixing to the sides of said two side-by-side pumps.

4. A unit as claimed in claim 3, characterised in that, for each of said ports (32) associated with the intake or delivery valves, said means comprise at least two threaded members (100) positioned about the respective port and operable from the outside.

5. A unit as claimed in claim 1, characterised by comprising alignment means (840) arranged to ensure that said shafts (7) are coaxial on assembling the component pumps of the unit.

6. A unit as claimed in claim 5, characterised in that said means consist of a pin which is partially inserted as a precise fit into two dead holes (84) provided in the facing ends (81) of and coaxially to said shafts.

7. A unit as claimed in claim 6, characterised in that said shafts (7) are provided with further coaxial dead holes (84) in their opposing ends (80).

8. A unit as claimed in claim 5, characterised in that said means consist of a ball.

9. A unit as claimed in claim 5, characterised in that said means consist of a barrel-shaped roller.

10. A unit as claimed in claim 5, characterised in that said means consist of a rod with frusto-conical opposing ends.

11. A unit as claimed in claim 1, characterised by comprising positioning means to ensure that the respective cranks (77) are positioned in phase opposition when said two pumps are assembled.

12. A unit as claimed in claim 11, characterised in that said means comprise:

- a pointer (44) positioned peripherally on the transverse face of each end of each shaft (7), typically in correspondence with the maximum or minimum eccentricity of the respective crank (77),
- a first reference mark (440) provided on the corresponding side (40) of the respective pump, and
- a second reference mark (4400) diametrically opposite the preceding, and also located on said side.

13. A diaphragm pump typically for the assembly of high capacity pump units, characterised by being formed and equipped in accordance with claim 1.

* * * * *